United States Patent [19]

Lowe

[11] Patent Number: 4,867,457

[45] Date of Patent: Sep. 19, 1989

[54] GOLF PUTTER HEAD

[75] Inventor: John D. Lowe, Shepherdstown, W. Va.

[73] Assignee: Puttru, Inc., Shepherdstown, W. Va.

[21] Appl. No.: 186,910

[22] Filed: Apr. 27, 1988

[51] Int. Cl.[4] ..... A63B 53/04

[52] U.S. Cl. ..... 273/167 B; 273/169; 273/164

[58] Field of Search ..... 273/167 A, 167 B, 167 C, 273/167 R, 167 D, 167 E, 167 F, 167 H, 167 J, 167 K, 78, 169, 171, 172, 164

[56] References Cited

U.S. PATENT DOCUMENTS

| | | | |
|---|---|---|---|
| D. 196,734 | 10/1963 | Solheim | D21/217 |
| D. 202,715 | 11/1965 | Solheim | D21/217 |
| D. 203,512 | 1/1966 | Solheim | D21/217 |
| D. 207,227 | 3/1967 | Solheim | D21/217 |
| D. 213,509 | 3/1969 | Solheim | D21/217 |
| D. 218,178 | 7/1970 | Solheim | 273/167 A |
| D. 240,245 | 6/1976 | Aragona | D21/217 |
| D. 248,181 | 6/1978 | Cervantes | 273/167 A |
| 3,088,736 | 5/1963 | Mospan | 273/167 A |
| 3,893,672 | 7/1975 | Schonher | 273/167 A |
| 4,140,318 | 2/1979 | Izette et al. | 273/167 A |
| 4,312,509 | 1/1982 | Grant | 273/167 A |
| 4,522,405 | 6/1985 | Clawges | 273/167 A |
| 4,664,385 | 5/1987 | Macera | 273/167 B |

FOREIGN PATENT DOCUMENTS

| | | | |
|---|---|---|---|
| 461375 | 11/1949 | Canada | 273/167 B |
| 7550 | 4/1900 | United Kingdom | 273/167 B |

*Primary Examiner*—George J. Marlo

*Attorney, Agent, or Firm*—Larson and Taylor

[57] ABSTRACT

A golf putter head has a vertical front face, a bottom surface, and a inclined face extending from a lower edge of the front face to a leading edge of the bottom surface. The inclined face is inclined rearwardly from the lower edge at about 50°-60° from vertical, and preferably about 56°. An elongate aperture is provided through the inclined face and the lower edge of the front face is vertically about 7/16th inch above the bottom surface. The lower edge is also preferably a horizontal line and the front face has a height which is greater than the distance from the lower edge to the bottom surface.

10 Claims, 1 Drawing Sheet

FIG. 1
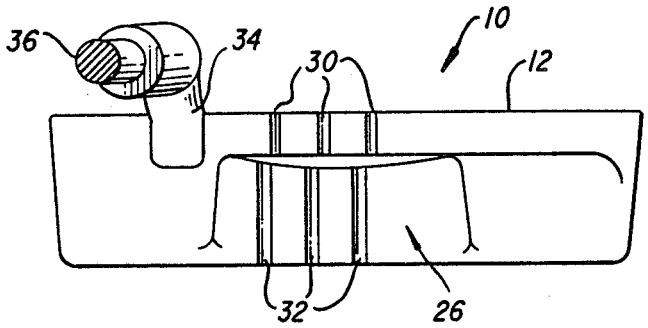
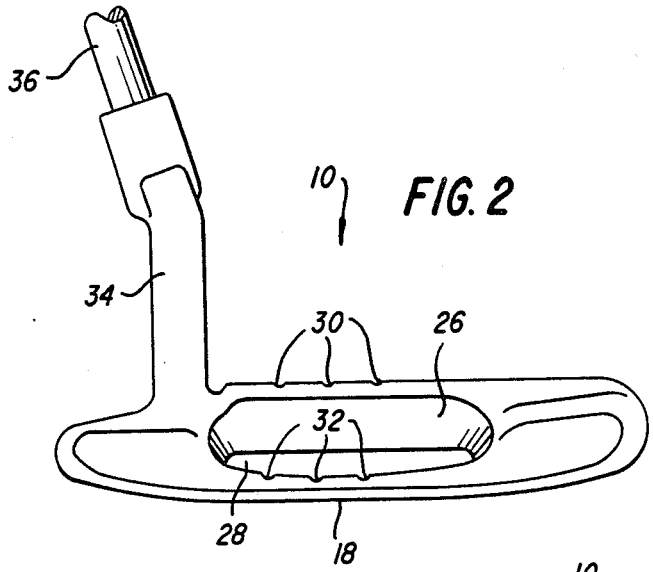
FIG. 2
FIG. 4
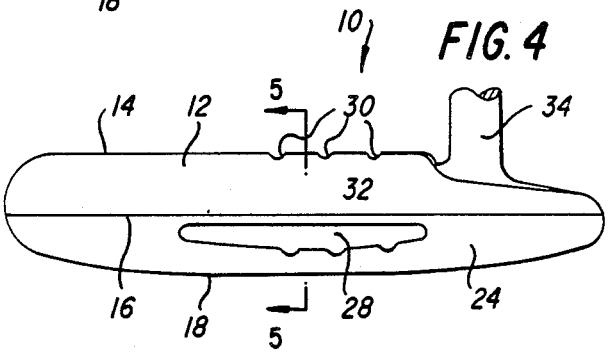
FIG. 3
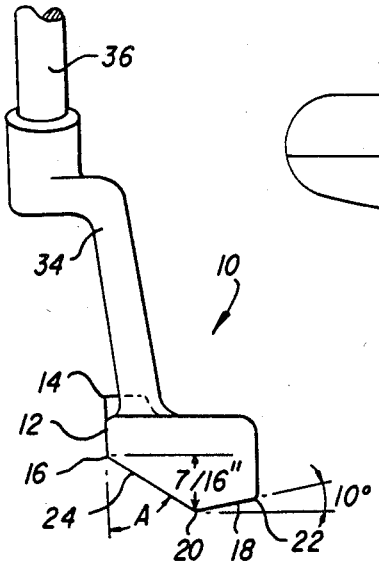
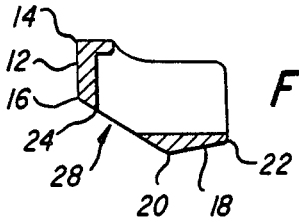
FIG. 5
LEGEND
A = 50°-60°
PREFERABLY 56°

GOLF PUTTER HEAD

FIELD OF THE INVENTION

The present invention relates generally to golf putters, and more particularly to a golf putter head which reduces skipping of the golf ball when the golf ball is initially struck with the putter head.

BACKGROUND OF THE INVENTION

Various golf putters have been disclosed in the prior art which are designed for better putting. For example, in U.S. Pat. No. 4,664,385 (Macera), a putter head is disclosed in which the ball striking surface is inclined at an angle of 20°–25° so that the golf ball is struck at a height greater than the radius of the golf ball. Another golf putter in which the bottom surface is somewhat upwardly inclined from the rear face to the front face to avoid stubbing of the putter during a stroke is disclosed in U.S. Pat. No. 4,522,405 (Clawges).

A golf putter having a broad trapezoidal shape with lower base elements is disclosed in U.S. Pat. No. 4,312,509 (Grant). One of the base elements is lower than the other, so that the user is required to have his hands in front of the putter head when striking the ball in order for the striking face to be vertical. Another golf putter which is designed in order to require the hands of the user to be in front of the putter head in order to keep the striking surface vertical is disclosed in U.S. Pat. No. 4,140,318 (Izett et al).

A golf putter design in which the putter head has a small rectangular cut out between the bottom surface and vertical striking surface is disclosed in U.S. Des. Patent No. 240,245 (Aragona).

While many various designs of putter heads have been described in the prior art, the avoidance of a skipping of the golf ball when first struck by the putter has not been avoided.

SUMMARY OF THE INVENTION

In accordance with the present invention, a golf putter head for attachment to a shaft includes a vertical front face having an upper edge and a lower edge. A bottom surface is further provided having a leading edge and a trailing edge. An inclined face extends from the lower edge of the front face to the leading edge of the bottom surface. This inclined face is inclined rearwardly from the lower edge at about a 50° to 60° angle from vertical.

In a preferred embodiment of the present invention, the inclination angle of the inclined face is about 56°. In addition, the lower edge of the front face is vertically about 7/16 inch above the bottom surface and is also a horizontal line.

In the preferred embodiment of the present invention, an elongate aperture is provided through the inclined face. This elongated aperture is elongated in the horizontal direction.

It is an object of the present invention to provide a golf putter head which would reduce the skipping imparted to the ball when being struck.

It is also an object of the present invention to immediately impart an overspin to a struck golf ball in order to prevent skipping.

Other features and objects of the present invention are stated in or apparent from a detailed description of a presently preferred embodiment of the invention found hereinbelow.

BRIEF DESCRIPTION OF THE DRAWINGS

FIG. 1 is a top plan view of a putter head according to the present invention.

FIG. 2 is a rear elevation view of the putter head depicted in FIG. 1.

FIG. 3 is a right elevation view of the putter head depicted in FIG. 1.

FIG. 4 is a front elevation view of the putter head depicted in FIG. 1.

FIG. 5 is a cross-sectional right elevation view of the putter head depicted in FIG. 1 taken along the line 5—5 in FIG. 4.

DETAILED DESCRIPTION OF THE PREFERRED EMBODIMENT

With reference now to the drawings which like numerals represent like elements through the several views, a preferred putter head 10 according to the present invention is depicted in FIGS. 1–4. Putter head 10 includes a front face 12 having an upper edge 14 and a lower edge 16. Putter head 10 also includes a bottom surface 18 having a leading edge 20 and a trailing edge 22. Bottom surface 18 is shown slightly inclined to horizontal at about 10° in this particular embodiment, although bottom surface 18 can be substantially horizontal if desired.

Connecting lower edge 16 of front face 12 and leading edge 20 of bottom surface 18 is an inclined face 24. Inclined face 24 is inclined at an angle A to vertical of about 50° to 60°, and preferably 56°.

In the preferred embodiment, putter head 10 resembles a PING type putter such as disclosed in U.S. Des. Pat. Nos. by Solheim having the following Nos.: 196,734; 202,715; 203,512; 207,227; and 213,509. However, with the present invention, the lower 7/16th inch of the front face of the putter has been cut away to form inclined face 24. With this construction, putter head 10 is somewhat lighter than an equivalent putter head, with a center of mass somewhat higher than an equivalent putter head.

As with PING putters of this type, a cutout 26 is provided behind front face 12. An elongate aperture 28 is thus provided in the preferred embodiment of the present invention through inclined face 24 to cutout 26. With the provision of elongate aperture 28, the center of mass of putter head 10 is further raised compared to a putter head in which inclined face 24 did not have such an elongate aperture. However, by suitably sculpturing putter head 10, the center of mass of putter head 10 can also be raised without the use of elongate aperture 28 if it were desired to omit elongate aperture 28.

Putter head 10 is also provided with grooves 30 and 32 as shown. Grooves 30 and 32 help with the aligning of putter head 10 with the ball to be struck during use.

As with putter heads common in the art, putter head 10 further includes a shank 34 to which a shaft 36 is suitably attached. In the embodiment of the present invention depicted in the drawings, shank 34 is of the "goose neck" variety. However, shank 34 can also be straight, or variations thereof well known to those of ordinary skill in the art as these variations are typically a matter of individual preference.

In use, putter head 10 is used in the normal manner for putting. However, due to the presence of inclined face 24, a golf ball which is struck by putter head 10 very quickly develops an overspin and hence rolls along the putting surface very soon after having been struck. In contrast, when a golf ball is struck with a normal putter having only a vertical face, the golf ball tends to skip along the putting surface when initially hit. During this skipping period, the golf ball is subject to additional forces which can adversely affect the path of the ball. Thus, by reducing the skipping distance, the accuracy with which a putted golf ball can be directed is increased.

Although the present invention has been depicted as resembling a PING type of putter head, it should be appreciated that all types of putter heads can advantageously incorporate the features of the present invention to produce a putting head which reduces skipping of the golf ball when struck with such a putter head.

While the present invention has been described with respect to an exemplary embodiment thereof, it will be understood by those of ordinary skill in the art that variations and modifications can be effected within the scope and spirit of the invention.

I claim:

1. A gold putter head for attachment to a shaft comprising:

a vertical front face (12) having an upper edge (14) and a lower edge (16);

a planar bottom surface (18) having a leading edge (20) and a trailing edge (22);

an inclined face (24) extending from the lower edge (16) of said front face (12) to said leading edge (20) of said bottom surface (18), said inclined face (24) being inclined rearwardly from said lower edge (16) at 50° to 60° from said vertical front face (12).

2. A golf putter head as claimed in claim 1 wherein the inclination angle of said inclined face (24) is 56°.

3. A golf putter head as claimed in claim 1 wherein an elongate aperture (28) is provided through said inclined face (24), said elongate aperture (28) being elongated in a horizontal direction along said inclined face (24).

4. A gold putter head as claimed in claim 1 wherein said lower edge (16) of said front face (12) is vertically 7/16th inch above the leading edge (20) of said bottom surface (18).

5. A golf putter head as claimed in claim 1 wherein said lower edge (16) of said front face (12) is a horizontal line.

6. A golf putter head as claimed in claim 1 wherein said front face (12) has a vertical height from the upper edge (14) to the lower edge (16) which is greater than the vertical distance from said lower edge (16) to the leading edge (20) of said bottom surface (18).

7. A golf putter head for attachment to a shaft comprising:

a planar bottom surface (18) having a leading edge (20) and a trailing edge (22);

a substantially vertical front face (12) having an upper edge (14) and a lower edge (16), said lower edge (16) being located 7/16th inch vertically above said leading edge (20) of said bottom surface (18); and an inclined planar face (24) extending from the lower edge (16) of said front face (12) to the leading edge (20) of said bottom surface (18), said inclined face (24) being inclined rearwardly from said lower edge (16) at an angle of 56° from said vertical front face (12).

8. A golf putter head as claimed in claim 7 wherein an elongate aperture (28) is provided through said inclined face (24), said elongate aperture (28) being elongated in a horizontal direction along said inclined face (24).

9. A golf putter head as claimed in claim 8 wherein said front face (12) has a vertical height from the upper edge (14) to the lower edge (16) which is greater than the vertical distance from said lower edge (16) to the leading edge (20) of said bottom surface (18).

10. A golf putter head as claimed in claim 7 wherein said bottom surface (18) is inclined upwardly from horizontal from said leading edge (20) to said trailing edge (22) at 10°.

* * * * *